US007497196B2

(12) United States Patent
Prior

(10) Patent No.: US 7,497,196 B2
(45) Date of Patent: Mar. 3, 2009

(54) INTAKE ASSEMBLY HAVING HELMHOLTZ RESONATORS

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 8 days.

(21) Appl. No.: 11/609,444

(22) Filed: Dec. 12, 2006

(65) Prior Publication Data

US 2008/0135010 A1 Jun. 12, 2008

(51) Int. Cl.
*F02M 35/104* (2006.01)
*F02M 35/12* (2006.01)
*F01N 1/02* (2006.01)

(52) U.S. Cl. ..... 123/184.57; 181/229

(58) Field of Classification Search ..... 123/184.57, 123/184.21, 559.1; 181/229, 224
See application file for complete search history.

(56) References Cited

U.S. PATENT DOCUMENTS 5,479,885 A * 1/1996 Ausiello et al. ..... 123/184.55
6,135,079 A 10/2000 Fuesser
6,178,940 B1 * 1/2001 Gossling et al. ..... 123/184.57
6,508,219 B2 * 1/2003 Schorn ..... 123/184.57
6,609,489 B1 8/2003 Slopsema et al.
6,783,579 B2 * 8/2004 Pettipiece ..... 96/384
6,792,907 B1 9/2004 Kostun et al.
6,959,679 B2 * 11/2005 Concialdi ..... 123/184.57
7,198,017 B2 * 4/2007 Vogt et al. ..... 123/184.57
2002/0043235 A1 * 4/2002 Stuart ..... 123/184.57
2004/0007197 A1 * 1/2004 Hellie et al. ..... 123/184.57
2006/0027204 A1 * 2/2006 Vogt et al. ..... 123/184.57

* cited by examiner

*Primary Examiner*—Michael Cuff
*Assistant Examiner*—Hyder Ali

(57) ABSTRACT

An intake assembly operable to communicate intake air to an internal combustion engine is provided. The intake assembly includes an inlet adapter defining a flow conduit through which the intake air may pass and an intake manifold. The inlet adapter is removably mounted with respect to the intake manifold. At least one resonance chamber is defined by at least one of the inlet adapter and the intake manifold. A gasket member is operable to substantially seal the inlet adapter with respect to the intake manifold. The gasket member defines at least one tuner neck operable to provide communication between the at least one resonance chamber and the flow conduit to form at least one Helmholtz resonator.

13 Claims, 1 Drawing Sheet

INTAKE ASSEMBLY HAVING HELMHOLTZ RESONATORS

TECHNICAL FIELD

The present invention relates to an intake assembly for an internal combustion engine having a Helmholtz resonator incorporated therein.

BACKGROUND OF THE INVENTION

Various methods may be employed to reduce the intake noise of an internal combustion engine. One method is to use a Helmholtz resonator on an intake air pipe configured to communicate intake air to the internal combustion engine. The intake air pipe is typically disposed upstream from an intake manifold and is configured to communicate intake air to the intake manifold of the internal combustion engine. A Helmholtz resonator includes a resonance volume or chamber having a small opening, typically referred to as a neck. The neck is operable to enable communication between the resonance chamber and the intake air pipe. Sound waves generated by components within the internal combustion engine travel along the intake air pipe where their acoustic pressure impinges on the neck. This acoustic pressure excites a mass of air within the neck. The acoustic pressure within the resonance chamber reacts against the air mass within the neck and produces an out-of-phase acoustic pressure at the intake air pipe to cause cancellation of intake noise at the resonant frequency. In this way, some of the engine noise is eliminated as the out-of-phase acoustic pressures in the intake air pipe cancel each other.

The frequency at which the attenuating acoustic pressures reach their maximum amplitude is known as the resonant frequency. A number of parameters determine the resonant frequency and bandwidth of a Helmholtz resonator, including the volume of the resonance chamber and the length and cross sectional area of the neck. Minor changes to the length and cross sectional area of the neck may alter the resonance frequency and thereby reduce the effectiveness of the Helmholtz resonator.

SUMMARY OF THE INVENTION

An intake assembly operable to communicate intake air to an internal combustion engine is provided. The intake assembly includes an inlet adapter defining a flow conduit through which the intake air may pass and an intake manifold. The inlet adapter is removably mounted with respect to the intake manifold. At least one resonance chamber is defined by at least one of the inlet adapter and the intake manifold. A gasket member is operable to substantially seal the inlet adapter with respect to the intake manifold. The gasket member defines at least one tuner neck operable to provide communication between the at least one resonance chamber and the flow conduit to form at least one Helmholtz resonator. The intake assembly may include a supercharger assembly operable to pressurize the intake air prior to communication to the internal combustion engine. An internal combustion engine incorporating the disclosed intake assembly is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
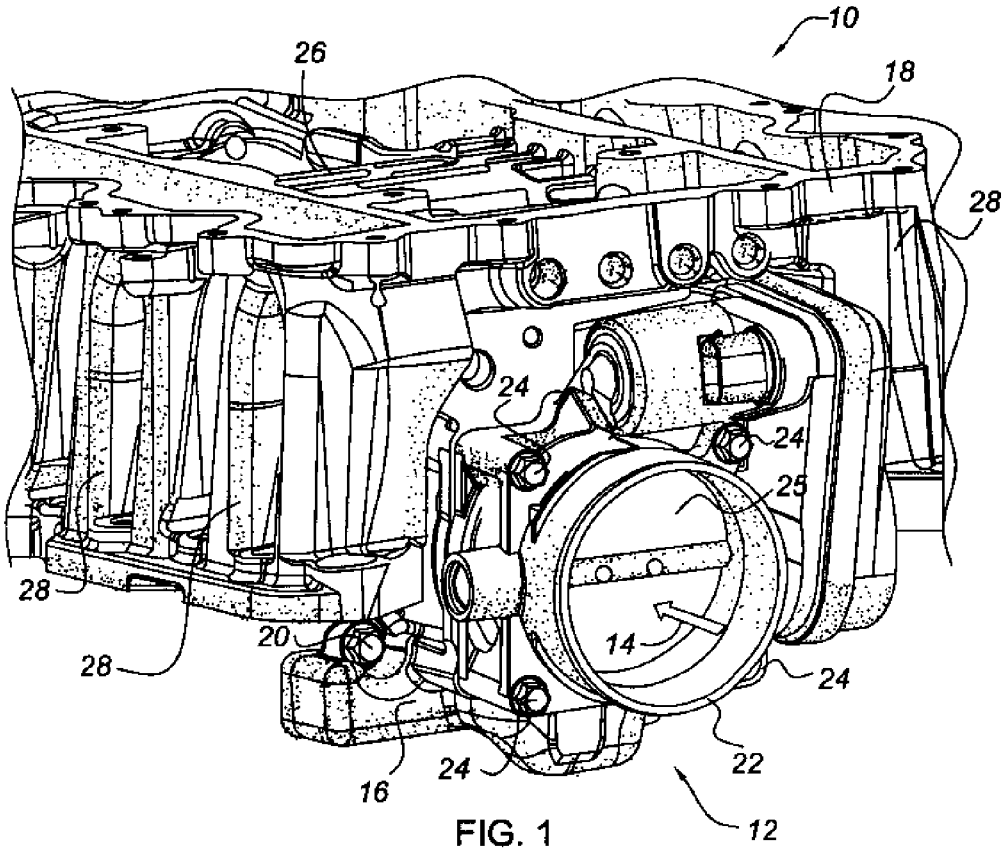
FIG. 1 is a fragmentary perspective view of a portion of an internal combustion engine illustrating an intake assembly consistent with the present invention.

Referring to the drawings wherein like reference numbers correspond to like or similar components throughout the several Figures there is shown in FIG. 1 a portion of an internal combustion engine, generally indicated at 10. The internal combustion engine 10 includes an intake assembly 12 operable to communicate intake air, indicated by arrow 14, to cylinders, not shown, within the internal combustion engine 10 to effect the combustion of fuel therein. The intake assembly 12 includes a first intake member, such as an inlet adapter 16, and a second intake member, such as an intake manifold 18. The inlet adapter 16 is removably mounted with respect to the intake manifold 18 through a plurality of fasteners 20, one of which is shown in FIG. 1. A throttle body 22 is mounted with respect to the inlet adapter 16 via a plurality of fasteners 24. The throttle body 22 includes a rotatable butterfly valve 25 which operates to selectively and variably communicate intake air 14 to the inlet adapter 16 for subsequent introduction to the intake manifold 18. The throttle body 22 of FIG. 1 is an electronically actuated device. That is, a controller, not shown, provides control signals to the throttle body 22 to effect movement of the butterfly valve 25. Those skilled in the art will recognize other methods of actuating the throttle body 22, such as a manually actuated cable, while remaining within the scope of that which is claimed.

The intake manifold 18 of FIG. 1 includes a supercharger assembly 26, such as a roots-type or screw-type supercharger, operable to pressurize the inlet air 14 prior to introduction to a plurality of intake runners 28. Each of the plurality of intake runners 28 operate to communicate the intake air 14 to a respective cylinder. In the preferred embodiment, the intake manifold 18 is formed from cast aluminum, however those skilled in the art will recognize other materials may be used to form the intake manifold 18, such as cast magnesium, etc. Additionally, the inlet adapter 16 of the present invention is preferably formed from cast aluminum, however those skilled in the art will recognize other materials may be used to form the inlet adapter 16, such as cast magnesium, cast iron, etc. Furthermore, the inlet adapter 16 may be formed from plastics or polymers while remaining within the scope of that which is claimed.

Figure 2:
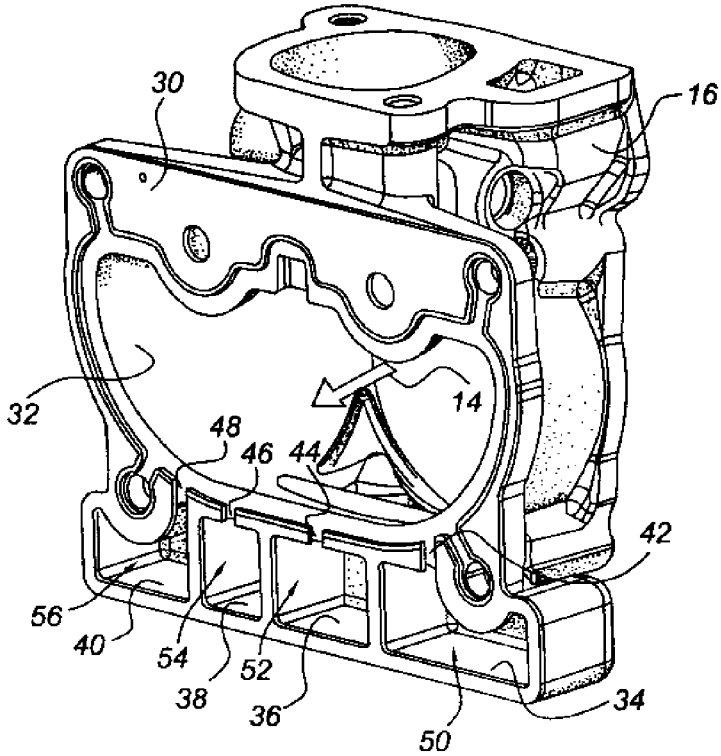
FIG. 2 is a perspective view of an inlet adapter and a gasket member of the intake assembly of FIG. 1 illustrating aspects of the present invention.

Referring now to FIG. 2, and with continued reference to FIG. 1, there is shown a perspective view of the inlet adapter 16 as viewed from the intake manifold 18, shown in FIG. 1. A gasket member 30 is operable to seal the inlet adapter 16 with respect to the intake manifold 18. The gasket member 30 is preferably a carrier or edge molded type gasket; however, other types of gaskets known to those skilled in the art may be used white remaining within the scope of that which is claimed. The inlet adapter 16 defines a flow conduit 32 operable to communicate intake air 14 to the intake manifold 18. The flow conduit 32 may be further defined by the intake manifold 18.

The inlet adapter 16 defines resonance volumes or chambers 34, 36, 38, and 40 which are in communication with the flow conduit 32 through a respective neck 42, 44, 46, and 48. The resonance chambers 34, 36, 38, and 40 and necks 42, 44, 46, and 48 cooperate to form respective Helmholtz resonators 50, 52, 54, and 56. As illustrated in FIG. 2, the necks 42, 44, 46, and 48 are defined by the gasket member 30, therefore no machining of the inlet adapter 16 is required to provide communication between the resonance chambers 34, 36, 38, and 40 and the flow conduit 32. Advantageously, by forming the necks 42, 44, 46, and 48 with the gasket member 30, the cost of producing the inlet adapter 16 may be reduced, while the length and cross sectional area of the necks 42, 44, 46, and 48 can be maintained within close tolerances. By maintaining the length and cross sectional area of the necks 42, 44, 46, and 48 within close tolerances, the tuning frequency of each of the Helmholtz resonators 50, 52, 54, and 56 is more precise. Should changes to the dimensions of the necks 42, 44, 46, and 48 be required, the gasket member 30 may be inexpensively altered at a reduction in cost compared to a machining change or casting change required by prior art inlet adapters. The gasket member 30 may be configured to form multiple necks for each resonance chambers 34, 36, 38, and 40, and the resonance chambers 34, 36, 38, and 40 may at least partially be defined by the intake manifold 18 while remaining within the scope of that which is claimed. Preferably, the resonance chambers 34, 36, 38, and 40 are formed during the formation of the inlet adapter 16 and/or the intake manifold 18. The gasket member 30 is also operable to seal the resonance chambers 34, 36, 38, and 40 from each other.

A plurality of tuning frequencies may be provided by varying the dimensions of the resonance chambers 34, 36, 38, and 40 and the respective necks 42, 44, 46, and 48. By positioning the Helmholtz resonators 50, 52, 54, and 56 near the noise source, i.e. the supercharger assembly 26, the pressure pulses acting on the structure of the intake manifold 18 and inlet adapter 16 may be reduced resulting in less radiation of noise than with noise attenuation devices mounted further upstream of the supercharger assembly 26. Additionally, the flow of intake air 14 may improve by employing the Helmholtz resonators 50, 52, 54, and 56 as a result of the cancellation of pressure pulses within the inlet adapter 16 and intake manifold 18.

While the best modes for carrying out the invention have been described in detail, those familiar with the art to which this invention relates will recognize various alternative designs and embodiments for practicing the invention within the scope of the appended claims.

The invention claimed is:

1. An intake assembly for an internal combustion engine comprising:

a first intake member defining a flow conduit through which intake air may pass;

a second intake member;

wherein said first intake member is mounted with respect to said second intake member;

at least one resonance chamber defined by at least one of said first intake member and said second intake member;

a gasket member operable to substantially seal said first intake member with respect to said second intake member; and wherein said gasket member defines at least one tuner neck operable to provide communication between said at least one resonance chamber and said flow conduit to form at least one Helmholtz resonator.

2. The intake assembly of claim 1, wherein the intake assembly includes a plurality of said resonance chambers and wherein said gasket member is operable to seal each of said resonance chambers from each other.

3. The intake assembly of claim 1, further comprising:

a throttle body operable to selectively and variably introduce said intake air to said flow conduit; and wherein said throttle body is mounted with respect to said first intake member.

4. The intake assembly of claim 1, wherein said second intake member is an intake manifold.

5. The intake assembly of claim 4, wherein the intake assembly includes a supercharger.

6. The intake assembly of claim 1, wherein at least one of said first and second intake members is cast and wherein said at least one resonance chamber is formed during casting of said at least one of said first and second intake members.

7. An intake assembly operable to communicate intake air to an internal combustion engine, the intake assembly comprising:

an inlet adapter defining a flow conduit through which the intake air may pass;

an intake manifold;

wherein said inlet adapter is removably mounted with respect to said intake manifold;

at least one resonance chamber defined by at least one of said inlet adapter and said intake manifold;

a gasket member operable to substantially seal said inlet adapter with respect to said intake manifold;

wherein said gasket member defines at least one tuner neck operable to provide communication between said at least one resonance chamber and said flow conduit to form at least one Helmholtz resonator; wherein the intake assembly includes a plurality of said resonance chambers; and wherein said gasket member is operable to seal each of said resonance chambers from each other.

8. The intake assembly of claim 7, further comprising:

a throttle body operable to selectively and variably introduce the intake air to said flow conduit; and wherein said throttle body is mounted with respect to said inlet adapter.

9. The intake assembly of claim 7, wherein the intake assembly includes a supercharger.

10. An internal combustion engine comprising:

an intake assembly including:

a first intake member defining a flow conduit through which intake air may pass;

a second intake member;

wherein said first intake member is removably mounted with respect to said second intake member;

at least one resonance chamber defined by at least one of said first intake member and said second intake member;

a gasket member operable to substantially seal said first intake member with respect to said second intake member;

wherein said gasket member defines at least one tuner neck operable to provide communication between said at least one resonance chamber and said flow conduit to form at least one Helmholtz resonator; wherein said second intake member is an intake manifold; and wherein said intake assembly includes a supercharger.

11. The internal combustion engine of claim 10, wherein said intake assembly includes a plurality of said resonance chambers and wherein said gasket member is operable to seal each of said resonance chambers from each other.

12. The internal combustion engine of claim 10, wherein said intake assembly further includes:

a throttle body operable to selectively and variably introduce said intake air to said flow conduit; and wherein said throttle body is mounted with respect to said first intake member.

13. The internal combustion engine of claim 10, wherein said first intake member is an inlet adapter.

* * * * *